US008517607B2

(12) United States Patent
Yamamoto

(10) Patent No.: US 8,517,607 B2
(45) Date of Patent: Aug. 27, 2013

(54) X-RAY GENERATION DEVICE

(75) Inventor: Keiichiro Yamamoto, Yokohama (JP)

(73) Assignee: Job Corporation, Yokohama-shi, Kanagawa (JP)

( * ) Notice: Subject to any disclaimer, the term of this patent is extended or adjusted under 35 U.S.C. 154(b) by 0 days.

(21) Appl. No.: 13/810,597

(22) PCT Filed: Jul. 11, 2011

(86) PCT No.: PCT/JP2011/065814
§ 371 (c)(1),
(2), (4) Date: Jan. 16, 2013

(87) PCT Pub. No.: WO2012/011404
PCT Pub. Date: Jan. 26, 2012

(65) Prior Publication Data

US 2013/0114794 A1 May 9, 2013

(30) Foreign Application Priority Data

Jul. 21, 2010 (JP) ..... 2010-164249

(51) Int. Cl.
*H01J 35/16* (2006.01)

(52) U.S. Cl.
USPC ..... 378/203

(58) Field of Classification Search
USPC ..... 378/119, 121, 203
See application file for complete search history.

(56) References Cited

U.S. PATENT DOCUMENTS

| | | | |
|---|---|---|---|
| 5,083,307 | A | 1/1992 | Meinel et al. |
| 2006/0098778 | A1 | 5/2006 | Oettinger et al. |
| 2010/0310053 | A1 | 12/2010 | Yamamoto |

FOREIGN PATENT DOCUMENTS

| | | | |
|---|---|---|---|
| JP | 58-71999 | U | 5/1983 |
| JP | 60-112297 | A | 6/1985 |
| JP | 61-66399 | A | 4/1986 |
| JP | 61-198599 | A | 9/1986 |
| JP | 1986-161900 | U | 10/1986 |
| JP | 1991-76399 | U | 7/1991 |
| JP | 06-111991 | A | 4/1994 |
| JP | 09-45493 | A | 2/1997 |
| JP | 2002-252099 | A | 9/2002 |
| JP | 2006-520068 | A | 8/2006 |
| JP | 2007-80568 | A | 3/2007 |
| JP | 2007-141510 | A | 6/2007 |
| JP | 2009-238742 | A | 10/2009 |

*Primary Examiner* — Courtney Thomas
(74) *Attorney, Agent, or Firm* — Jacobson Holman PLLC

(57) ABSTRACT

Provided is an X-ray generation device including an X-ray tube and a high-voltage generation unit arranged inside a housing and also having insulating oil filled in the housing, which uses no lead and is small in size, thereby achieving a reduction in manufacturing cost, and which also has high cooling performance. An X-ray generation device 1 includes an X-ray tube 2 and a high-voltage generation unit 3 inside a housing 8 and also has insulating oil 4 filled in the housing 8, the X-ray tube 2 being configured to generate an X ray, the X-ray generation device 1 characterized in that the X-ray tube 2 is arranged inside an X-ray tube holder 10, a material of the X-ray tube holder 10 contains at least bismuth oxide and a resin, and the X-ray tube holder 10 includes an opening and a plurality of slits 11, the opening being provided in a portion corresponding to an X-ray irradiation window 7 through which the X-ray tube 2 applies the X ray, the slits 11 allowing the insulating oil 4 to circulate between an inside and an outside of the X-ray tube holder 10.

9 Claims, 5 Drawing Sheets

X-RAY GENERATION DEVICE

CROSS-REFERENCE TO RELATED APPLICATIONS

The present patent application is a nationalization of International application No. PCT/JP2011/065814, filed Jul. 11, 2011 published in Japanese, which is based on, and claims priority from, Japanese Application No. 2010-164249, filed Jul. 21, 2010, both of which are incorporated herein by reference in their entireties.

TECHNICAL FIELD

The present invention relates to an X-ray generation device. Specifically, the present invention relates to an X-ray generation device used in nondestructive testing for detecting foreign matters and/or the like in a test subject such as a food item or an industrial product by irradiating the test subject with an X ray and studying the amount of X ray transmitted. The present invention relates also to an X-ray generation device used in testing in the medical field.

BACKGROUND ART

Heretofore, small-sized X-ray generation devices have been used in industrial nondestructive testing, testing for animals such as pets, and dental diagnoses. Among those, X-ray generation devices of a type called mono tank or mono block have been used in which an X-ray tube and a high-voltage generation unit are mounted inside a single housing (see Patent Document 1, for example).

FIG. 9 shows one example of the mono-tank X-ray generation device. This X-ray generation device (mono tank) 1X includes, inside a housing 8, an X-ray tube 2 and a high-voltage generation unit 3 configured to supply power to the X-ray tube 2. Further, insulating oil 4 is filled inside the housing 8. The X-ray tube 2 includes an anode 5 and a cathode 6. Moreover, an anode heat radiator 17 is arranged on the anode 5 of the X-ray tube 2. Further, the X-ray tube 2 is surrounded by insulators 21 and 31 and an X-ray shielding member 32 for preventing scattering of X rays. Note that L1 indicating a broken line represents the path which thermal electrons and an X ray for irradiation travel; 7, an X-ray irradiation window; 23, an X-ray irradiation flange, and F, a focal spot.

Next, an operation of the X-ray generation device 1X will be described. First, the high-voltage generation unit 3 applies voltages of from 10 kV to 500 kV to the X-ray tube 2. Specifically, +50 kV and −50 kV, for example, are applied to the anode 5 and the cathode 6, respectively (a voltage difference of 100 kV). With this electricity, a filament, which is the cathode 6 of the X-ray tube 2, lights up and emits thermal electrons. The thermal electrons collide with the anode 5 on the opposite side (this spot is the focal spot F). The energy of this collision generates an X ray. This X ray is taken out to the outside through the X-ray irradiation window 7 as an X ray for irradiation L1, and then put into use.

During this operation of the X-ray generation device 1X, the X-ray tube 2 and the housing 8 are at ±50 kV and ±0 V, respectively, for example. This potential difference may possibly cause electric discharge (spark). To prevent this electric discharge, the insulators 21 and 31 are disposed around the X-ray tube 2, and the insulating oil 4 is filled. For these insulators 21 and 31, a resin resistant to the insulating oil or a ceramic is used. Note that the insulating oil 4 also has a function of cooling down the X-ray tube 2, in addition to the function of preventing the electric discharge.

Meanwhile, since the X ray scatters radially at the focal spot F on the anode 5, X rays may possibly be emitted in all directions in the X-ray generation device 1X. To prevent exposure to such X rays, the X-ray shielding member 32 is disposed around the X-ray tube 2. For this X-ray shielding member 32, lead is used in general for its high X-ray shielding effect.

The X-ray generation device 1X described above has some problems. Firstly, it has a problem that lead is used for the X-ray shielding member 32. Lead is harmful to the human body and, when wasted, adversely affects the natural environment. Thus, it is desirable not to use lead. To replace lead, it is possible to use tungsten which has a high X-ray shielding rate. However, tungsten is expensive, costing about 12,000 yen to 15,000 yen per kilogram.

Secondly, the X-ray generation device 1X has a problem that there is a limitation in its miniaturization. This is because the X-ray generation device 1X needs the X-ray shielding member 32 of a sufficiently large thickness for shielding the scattering X rays, and also because the X-ray generation device 1X needs the insulators 21 and 31 of a sufficiently large thickness for preventing the electric discharge. Note that the X-ray shielding effect is proportional to the thickness of the X-ray shielding member 32. Likewise, the insulating effect is proportional to the thickness of the insulators 21 and 31.

PRIOR ART DOCUMENT

Patent Document

Patent Document 1: Japanese patent application Kokai publication No. 2007-80568

SUMMARY OF THE INVENTION

Problems to be Solved by the Invention

The present invention has been made in view of the above problems, and an object thereof is to provide an X-ray generation device including an X-ray tube and a high-voltage generation unit arranged inside a housing and also having insulating oil filled in the housing, which uses no lead and is small in size, thereby achieving a reduction in manufacturing cost and environmental load, and which also has high cooling performance.

Means for Solving the Problems

An X-ray generation device for achieving the above object according to the present invention is an X-ray generation device including an X-ray tube and a high-voltage generation unit inside a housing and also having insulating oil filled in the housing, the X-ray tube being configured to generate an X ray, the X-ray generation device characterized in that the X-ray tube is arranged inside an X-ray tube holder, a material of the X-ray tube holder contains at least bismuth oxide and a resin, and the X-ray tube holder includes an opening and a plurality of slits, the opening being provided in a portion corresponding to an X-ray irradiation window through which the X-ray tube applies the X ray, the slits allowing the insulating oil to circulate between an inside and an outside of the X-ray tube holder.

By this configuration, an X-ray generation device using no lead can be provided. Moreover, bismuth oxide in itself is an insulator and has no electric conductivity unlike lead and tungsten. That is, by the configuration using bismuth oxide functioning as both an X-ray shielding member and an insulator, the miniaturization of the X-ray generation device can be achieved. Further, since an expensive material such as tungsten is not used for the X-ray shielding member, the manufacturing cost of the X-ray generation device can be reduced. Note that bismuth oxide costs about 3,000 yen per kilogram. In addition, by the configuration in which the plurality of slits are formed in the X-ray tube holder, the X-ray tube can be cooled down efficiently.

The above X-ray generation device is characterized in that the slits of the X-ray tube holder are formed along directions crossing advancing directions of X rays scattering radially from the X-ray tube. By this configuration, the X-ray tube holder can shield the X rays that scatter (scattering X rays).

The above X-ray generation device is characterized in that the X-ray tube holder is formed of a molded body obtained by molding a powder of bismuth oxide with an insulating resin, and a weight of the bismuth oxide accounts for 50% or greater of that of the X-ray tube holder. By this configuration, the X-ray shielding effect and insulating effect of the X-ray tube holder can be improved. This is because the X-ray shielding effect and insulating effect of the X-ray tube holder increase as the mass of the bismuth oxide contained therein increases.

The above X-ray generation device is characterized in that the X-ray tube holder is formed of a molded body obtained by molding a powder of bismuth oxide with an insulating resin, and a weight of the bismuth oxide accounts for 90% or greater of that of the X-ray tube holder. By this configuration, an operation and effect similar to that described above can be achieved.

The above X-ray generation device is characterized in that the X-ray tube holder includes an oil circulation passage connected to the slits, and a heat radiation unit connected to the oil circulation passage, and the X-ray tube holder has a configuration in which the insulating oil is sent to the heat radiation unit through the oil circulation passage, cooled down by the heat radiation unit, and returned into the X-ray tube holder. By this configuration, the cooling performance of the X-ray tube can be improved, thereby allowing continuous use of the X-ray generation device.

Effect of the Invention

According to the X-ray generation device according to the present invention, it is possible to provide an X-ray generation device which uses no lead and is small in size, thereby achieving a reduction in manufacturing cost, and which also has high cooling performance.

MODES FOR CARRYING OUT THE INVENTION

Figure 1:
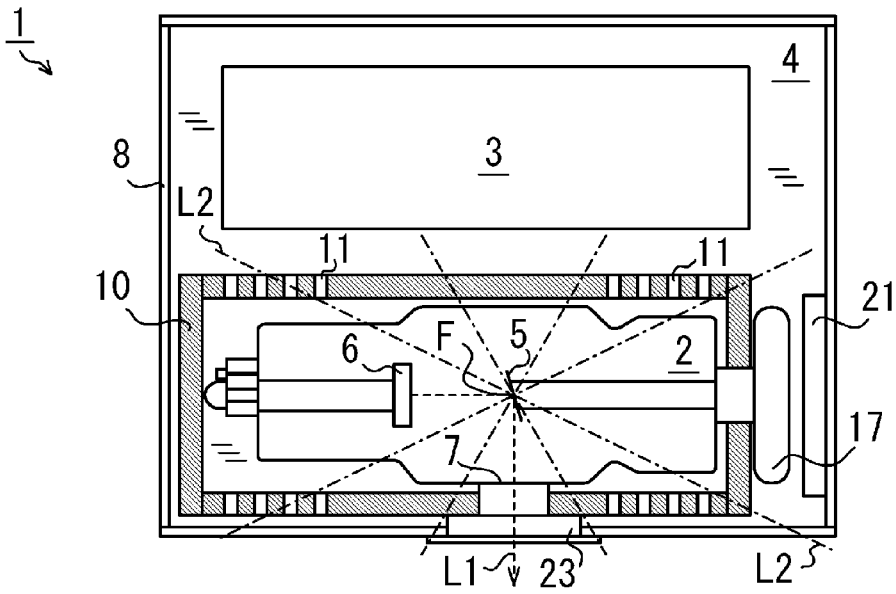
FIG. 1 is a view showing an X-ray generation device in an embodiment according to the present invention.

Hereinafter, X-ray generation devices in embodiments according to the present invention will be described with reference to the drawings. FIG. 1 shows an X-ray generation device 1 in an embodiment according to the present invention. The X-ray generation device 1 includes an X-ray tube 2 and a high-voltage generation unit 3 inside a housing 8, and also has insulating oil 4 filled inside the housing 8, the X-ray tube 2 being configured to generate an X ray. This X-ray tube 2 is arranged inside an X-ray tube holder 10. This X-ray tube holder 10 is a molded component obtained by solidifying bismuth oxide with a synthetic resin. Moreover, the X-ray tube holder 10 has multiple slits 11 for circulating the insulating oil 4. Further, an anode heat radiator 17 provided to the X-ray tube 2 is configured to be located outside the X-ray tube holder 10. An insulator 21 is arranged on the face of the housing 8 facing this anode heat radiator 17. Note that 5 represents an anode; 6, a cathode; 7, an X-ray irradiation window; L1, an X ray for irradiation; L2, scattering X rays; F, a focal spot at which the X rays are generated (the origin of the scattering X rays) ; and 23, an X-ray irradiation flange.

Next, the material of the X-ray tube holder 10 will be described. The X-ray tube holder 10 contains at least bismuth oxide. The X-ray tube holder 10 can be molded by mixing and heating a powder of bismuth oxide and a resin, for example. As the resin used here, any resin can be used as long as it has insulating properties and oil-proof properties. Specifically, an epoxy resin or the like is desirable.

Moreover, the X-ray shielding effect of the X-ray tube holder 10 increases as the content of bismuth oxide increases; thus, the X-ray tube holder 10 is configured to contain bismuth oxide by 50% or greater, desirably 70% or greater, and more desirably 90% or greater of the whole weight of the X-ray tube holder 10.

Table 1 shows the result of a test performed for the purpose of comparing the X-ray shielding effect of the X-ray tube holder 10. In Table 1, A to C show hourly amounts R of irradiation with X rays having passed through lead plates having different thicknesses t (unit: mm), respectively, while D and E show hourly amounts R of irradiation with X rays having passed through bismuth oxide plates having different bismuth oxide contents, respectively. From Table 1, it was found that a case of laying two 1-mm thick lead plates over one another (C), and a 6-mm thick bismuth oxide plate containing bismuth oxide by 87% (D) had substantially the same X-ray shielding effect. Moreover, it was found that increasing the content of bismuth oxide drastically improved the X-ray shielding effect, as can be seen in a bismuth oxide plate containing bismuth oxide by 90% (E).

In addition, a test for evaluating the insulating effect of each of the bismuth oxide plates (D) and (E) was performed. The breakdown voltage was 46 kV in the case of the 6-mm thick bismuth oxide plate containing bismuth oxide by 87% (D). Moreover, the breakdown voltage was 45 kV in the case of the 6-mm thick bismuth oxide plate containing bismuth oxide by 90% (E). From the above facts, it was found that the bismuth oxide plates (D) and (E) had high insulating properties. Note that the breakdown voltage refers to the voltage at which an insulator separating conductors breaks and becomes unable to maintain an insulating state.

TABLE 1

| Measurement Condition | | Exposure Rate (R/hr) | | | | |
|---|---|---|---|---|---|---|
| kV | mA | A Pb Plate t = 0.5 | B Pb Plate t = 1.0 | C Pb Plate t = 1.0 × 2 | D Bismuth Oxide Plate t = 6 (containing 87%) | E Bismuth Oxide Plate t = 6 (containing 90%) |
| 40 | 2.0 | 0 | 0 | 0 | 0 | 0 |
| 60 | 2.0 | 0.23 | 0 | 0 | 0 | 0 |
| 80 | 2.0 | 3.07 | 0.32 | 0 | 0 | 0 |
| 100 | 2.0 | 10.76 | 1.75 | 0.10 | 0.08 | 0.06 |
| 110 | 2.0 | 14.71 | 2.44 | 0.14 | 0.17 | 0.09 |
| 120 | 2.0 | 19.06 | 3.12 | 0.21 | 0.20 | 0.11 |
| 130 | 2.0 | 24.19 | 3.93 | 0.25 | 0.27 | 0.15 |
| 140 | 2.0 | 30.15 | 4.90 | 0.32 | 0.30 | 0.17 |
| 150 | 2.0 | 37.13 | 6.16 | 0.38 | 0.40 | 0.20 |

By the configuration described above, the following operations and effects can be achieved. Firstly, the X-ray generation device 1 using no lead can be provided by the configuration in which the X-ray tube holder 10 is molded by use of bismuth oxide solidified with a resin. Moreover, since the X-ray tube holder 10 can be produced in a way that a synthetic resin product is molded, the X-ray tube holder 10 can be obtained even in a complicated shape. Further, the X-ray tube holder 10 can be mass-produced easily.

Secondly, the X-ray generation device 1 can be miniaturized by the configuration in which the X-ray tube holder 10 functions as both an X-ray shielding member and an insulator. In the case of the conventional X-ray generation device in which a resin insulator and a lead X-ray shielding member are laid over one another, there is a possibility that electric discharge may occur from the X-ray tube's anode or cathode, to which high voltage is applied, to the lead part, or the X-ray shielding member, which is at a zero potential. For this reason, the lead X-ray shielding member needs to be separated from the X-ray tube by a sufficient distance. In the present invention, in the case of forming the X-ray tube holder 10 to a thickness of 6 mm, for example, this X-ray tube holder 10 can be said to be an X-ray shielding member having a thickness of 6 mm and also an insulator having a thickness of 6 mm. Hence, the configuration in which the X-ray tube holder 10 surrounds the X-ray tube 2 eliminates any part at a zero potential around the part of the anode or cathode of the X-ray tube 2 to which high voltage is applied. In this way, the gap between the X-ray tube 2 and the X-ray tube holder 10 can be set to a distance large enough to allow movement of the insulating oil. Specifically, this gap can be reduced to about 3 mm from about 10 mm employed in the conventional case . As a result, the miniaturization of the X-ray generation device 1 can be achieved.

Thirdly, the manufacturing cost of the X-ray generation device 1 can be reduced by not using an expensive insulator such as tungsten. Note that tungsten costs about 15,000 yen per kilogram whereas bismuth oxide costs about 3,000 yen per kilogram.

Fourthly, continuous use of the X-ray generation device 1 is made possible by the configuration in which the slits 11 are formed in the X-ray tube holder 10. This is because the insulating oil 4 having a cooling function can be circulated between the inside and outside of the X-ray tube holder 10.

Figure 2:
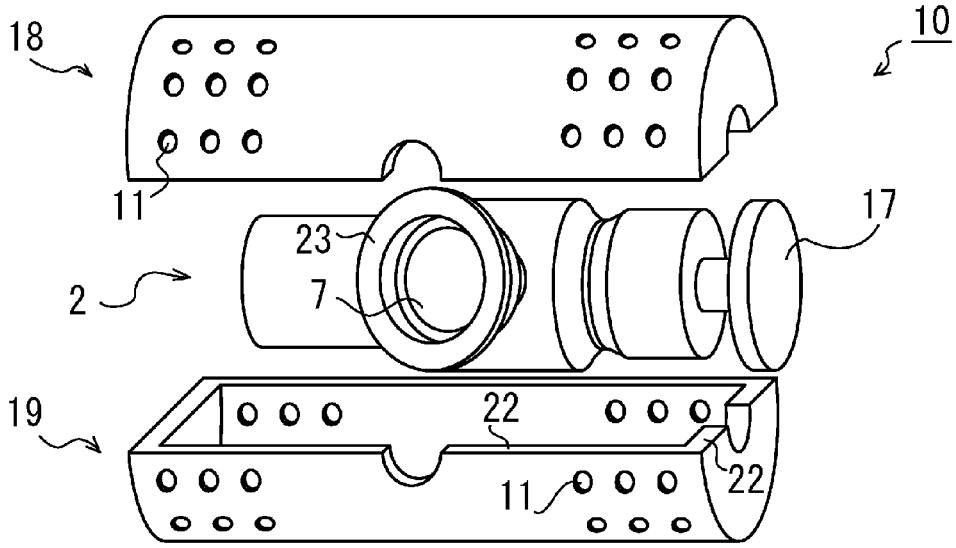
FIG. 2 is a perspective view showing an X-ray tube and an X-ray tube holder of the X-ray generation device in the embodiment according to the present invention.

FIG. 2 shows a perspective view of the X-ray tube 2 and the X-ray tube holder 10. The X-ray tube holder 10 is in a cylindrical shape and formed of an upper holder 18 and a lower holder 19 divided from each other at joining surfaces 22. Moreover, the X-ray tube holder 10 has the multiple slits 11 penetrating therethrough to the inside and outside. The X-ray tube 2 is configured to be mounted inside this X-ray tube holder 10. Note that while the slits 11 have circular openings, they may have rectangular openings.

Figure 3:
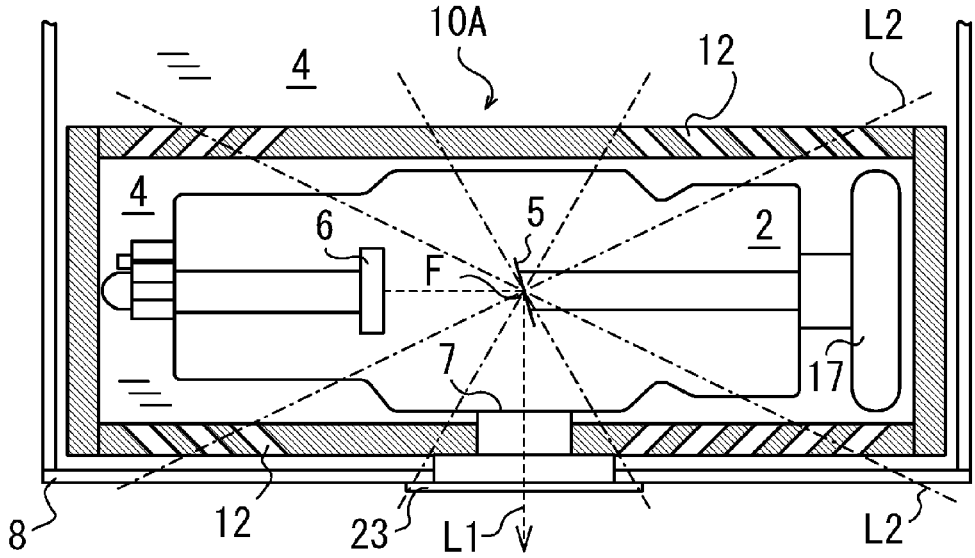
FIG. 3 is a view showing an X-ray tube holder of the X-ray generation device in a different embodiment according to the present invention.

FIG. 3 shows an X-ray tube holder 10A of the X-ray generation device in a different embodiment according to the present invention. This X-ray tube holder 10A has multiple slanted slits 12. These slanted slits 12 are configured such that the scattering X rays L2 fall on the sidewalls of the slanted slits 12. Moreover, in addition to the X-ray tube 2, the anode heat radiator 17 is configured to be mounted inside the X-ray tube holder 10A.

By the configuration described above, the following operations and effects can be achieved. Firstly, the amount of flow of the insulating oil 4 between the inside and outside of the X-ray tube holder 10A can be increased by the configuration in which the slits are configured as the slanted slits 12, thereby allowing an improvement in the cooling efficiency of the X-ray tube 2. This is because the slits can be configured to have a larger opening area than the slits 11 shown in FIG. 1. Note that the slanted slits 12 are formed along directions crossing the advancing directions of the scattering X rays L2, and therefore the scattering X rays L2 will never pass through the openings of the slanted slits 12 and scatter to the outside.

Secondly, the manufacturing cost of the X-ray generation device can be reduced. This is because the configuration in which the anode heat radiator 17 is mounted inside the X-ray tube holder 10A eliminates the need for works such as attaching the insulator 21 (see FIG. 1) to the housing 8, thereby simplifying the work of assembling the X-ray generation device 10A.

Figure 4:
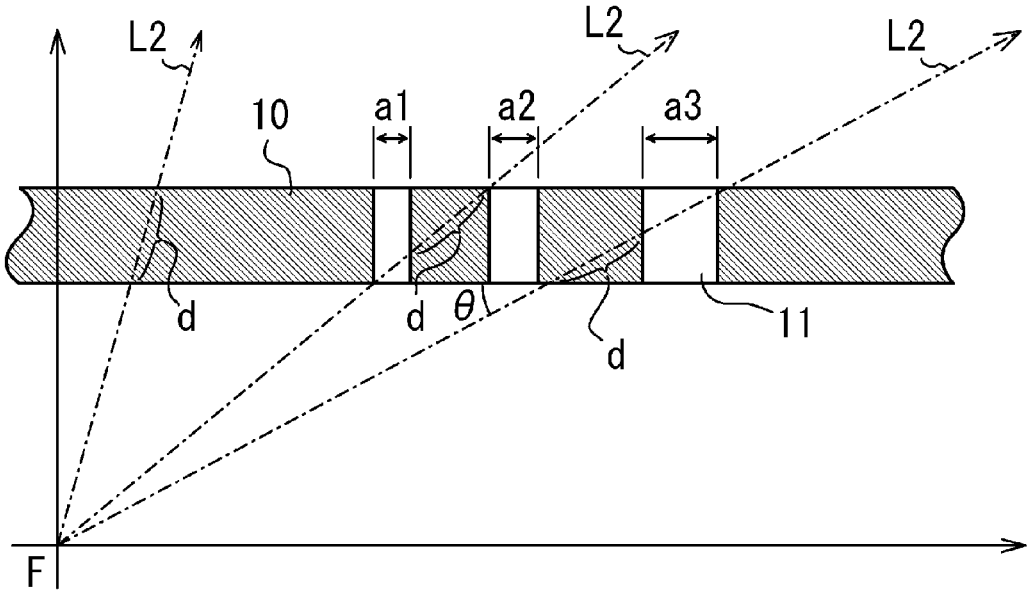
FIG. 4 is an enlarged view of the periphery of slits in the X-ray generation device in the embodiment according to the present invention.

FIG. 4 shows an enlarged view of the periphery of the slits 11 (see FIG. 1) formed in the X-ray tube holder 10. These multiple slits 11 have openings of different widths (a1 to a3). Meanwhile, the distance of transmission of scattering X rays L2 across the X-ray tube holder 10 is shown as an X-ray shielding distance d. This X-ray shielding distance d is set to a length long enough to shield the scattering X rays L2 and is determined based on the material of the X-ray tube holder 10. Note that F represents the focal spot at which the scattering X rays L2 are generated.

Next, the conditions to determine the width of the openings of each slit 11 will be described. Firstly, to shield the scattering X rays L2, each slit 11 is disposed and the width of the openings thereof is determined such that the apparent thicknesses of the X-ray tube holder 10 with respect to the scattering X rays L2 are greater than the X-ray shielding distance d. Secondly, each slit 11 is designed such that the openings thereof have the maximum width in the range described above. This is for increasing the amount of flow of the insulating oil 4 flowing through the slit 11 to thereby enhance the cooling effect.

The widths (a1 to a3) of the openings of the multiple slits 11 may be set equal to each other or changed from one location to another. Specifically, it is desirable to set larger values to the widths of the openings of the slits 11 (e.g. a3) that are more remote from the focal spot F from which each scattering X ray L2 is emitted. This is because an incident angle θ of the scattering X ray L2 on the X-ray tube holder 10 is smaller (closer to 0°) when the incidence is more remote from the focal spot F, thereby increasing the thickness of the X-ray shielding member existing on the path of the scattering X ray L2, that is, increasing the apparent thickness of the X-ray shielding member. Accordingly, the scattering X ray L2 can be shielded even if a large width is set to the openings of the slit 11.

Figure 5:
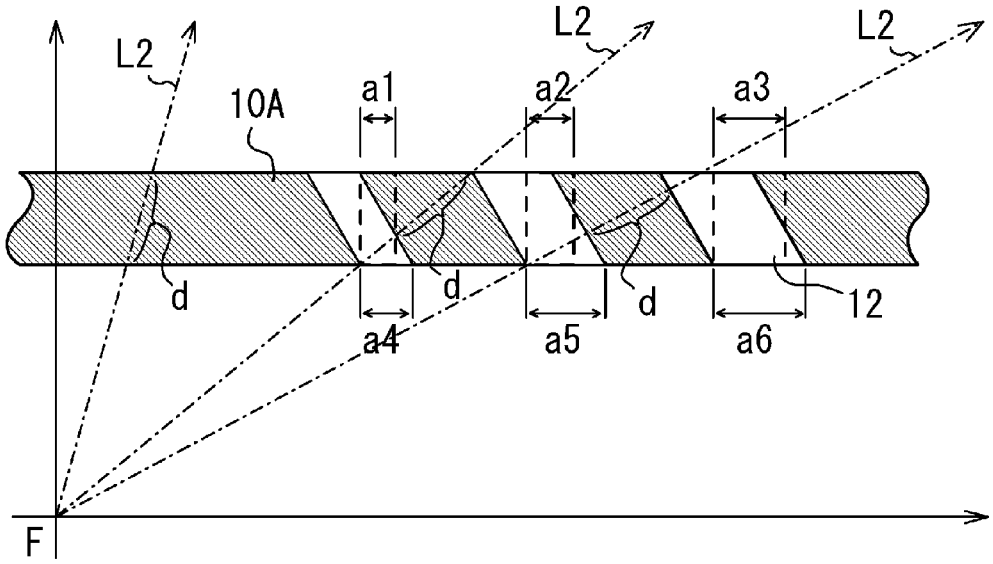
FIG. 5 is an enlarged view of the periphery of slits in the X-ray generation device in the different embodiment according to the present invention.

FIG. 5 shows an enlarged view of the periphery of the slanted slits 12 (see FIG. 3) formed in the X-ray tube holder 10A. These multiple slanted slits 12 have openings of different widths (a4 to a6). The slanted slits 12 are slanted in such directions that the sidewalls of the slanted slits 12 face the focal spot F. For this reason, even when the slanted slits 12 are designed in such a way as to have the same shielding distance as the X-ray shielding distance d shown in FIG. 4, the widths of the openings of the slanted slits 12 (a4 to a6) can be made greater than a1 to a3. Accordingly, the amount of flow of the insulating oil 4 flowing therethrough can be increased, thereby allowing an improvement in the cooling performance of the X-ray generation device 1.

Figure 6:
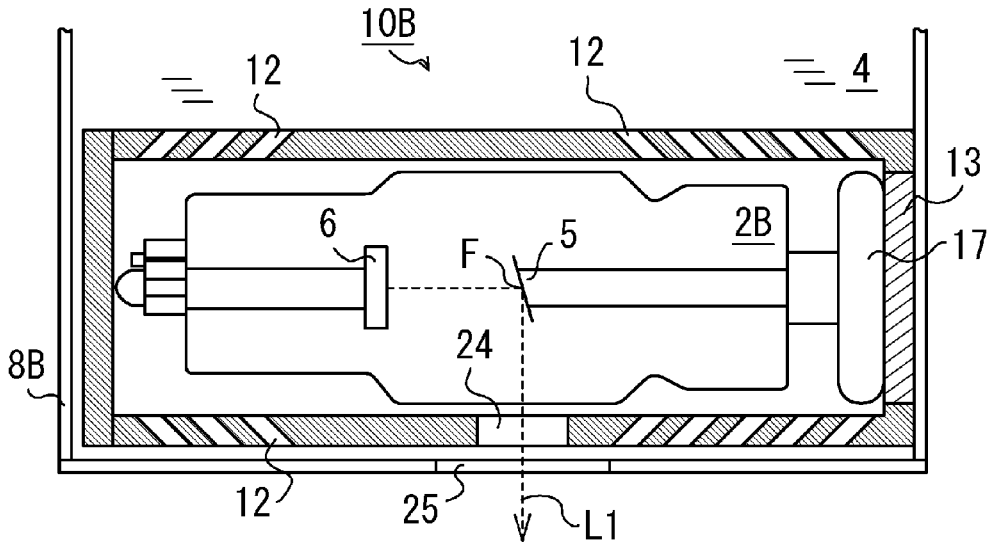
FIG. 6 is a view showing an X-ray tube holder of the X-ray generation device in a different embodiment according to the present invention.

FIG. 6 shows an X-ray tube holder 10B of the X-ray generation device in a different embodiment according to the present invention. Part of this X-ray tube holder 10B serves as a heat conducting member 13. Moreover, the anode heat radiator 17 and the heat conducting member 13 are set in tight contact with each other. Further, the heat conducting member 13 and the housing 8 are set in tight contact with each other. Note that the heat conducting member 13 only needs to have insulating properties and heat conduction properties, and aluminum nitride or the like can be utilized, for example.

Further, this X-ray generation device uses an X-ray tube 2B not including the X-ray irradiation flange 23. The X ray for irradiation L1 emitted from this X-ray tube 2B is applied by passing through an opening 24 provided in the X-ray tube holder 10B and an irradiation port cover 25 provided to a housing 8B. Here, for the irradiation port cover 25, used is a material which does not allow the insulating oil 4 from leaking to the outside but allows the X ray to pass therethrough. In particular, as the material of the irradiation port cover 25, it is desirable to use a material high in X-ray transmittance and also high in X-ray durability. Specifically, as the material, it is desirable to use aluminum, a plastic, carbon, or the like.

By the configuration described above, the following operations and effects can be achieved. Firstly, the cooling performance of the anode heat radiator 17 can be improved. This is because the anode heat radiator 17 can be cooled down by means of a material high in heat conductivity. Here, the anode heat radiator 17 is desirably composed of copper which has a high X-ray shielding effect. Thus, as the heat conducting member 13, it is possible to select a member having superior heat conductivity over the X-ray shielding effect. Note that the anode heat radiator 17 and the heat conducting member 13 as well as the heat conducting member 13 and the housing 8 can be configured to be in tight contact with each other, or to have a space in between so that the insulating oil 4 can be circulated therethrough.

Moreover, the opening 24 may be configured to be closed by a material having high X-ray transmittance and also high insulating properties. Specifically, the opening 24 may be closed by beryllia (sintered beryllium oxide), a plastic, or the like. By this configuration, it is possible to reduce the possibility of electric discharge occurring between the X-ray tube 2B and the housing 8B and between the X-ray tube 2B and the irradiation cover 25.

Figure 7:
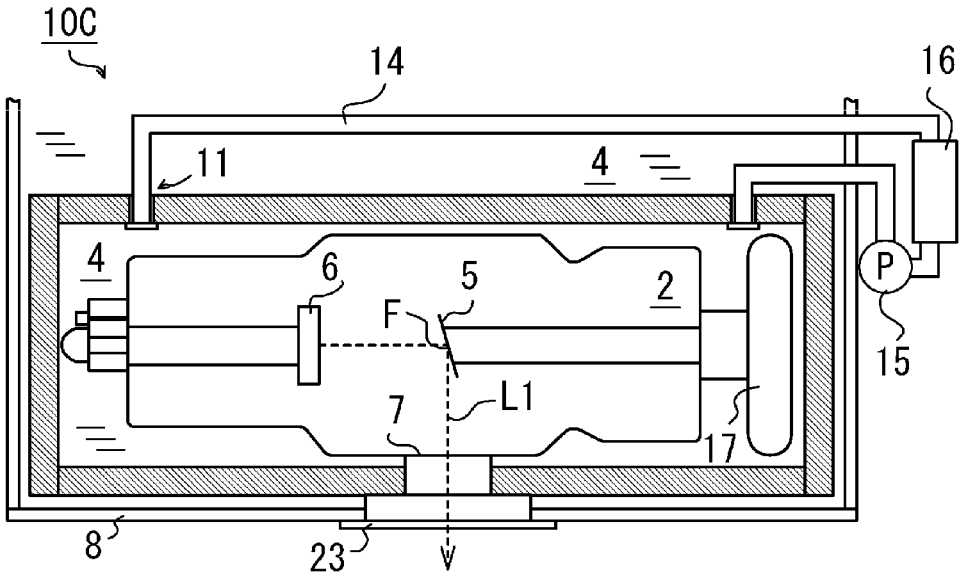
FIG. 7 is a view showing an X-ray tube holder of the X-ray generation device in a different embodiment according to the present invention.

FIG. 7 shows an X-ray tube holder 10C of the X-ray generation device in a different embodiment according to the present invention. This X-ray tube holder 10C is such that the slits 11 formed in the holder 10C are connected to an oil circulation passage 14. This oil circulation passage 14 is configured to be capable of cooling down and circulating the insulating oil 4 in the X-ray tube holder 10C by means of a heat radiation unit 16 and a pump 15. Here, as the heat radiation unit 16, a device including heat radiation fins, a device including a heat exchanger, or the like can be utilized.

Note that while the pump 15 and the heat radiation unit 16 are disposed outside the housing 8 in FIG. 7, the present invention is not limited to this configuration. The pump 15, or the pump 15 and the heat radiation unit 16 can be disposed inside the housing 8. This configuration eliminates the need for large heat exchanging mechanisms outside the X-ray generation device. Accordingly, the X-ray generation device can be formed to be small as a whole.

By the configuration described above, the cooling efficiency of the X-ray tube 2 can be drastically improved. This is because the insulating oil 4 in the X-ray tube holder 10C is forcibly circulated, thereby allowing an improvement in the cooing performance of the X-ray tube 2. It is desirable to select the configuration of FIG. 7 when the X-ray generation device 1 focuses more on the number of times it can be used continuously than on the size thereof.

Figure 8:
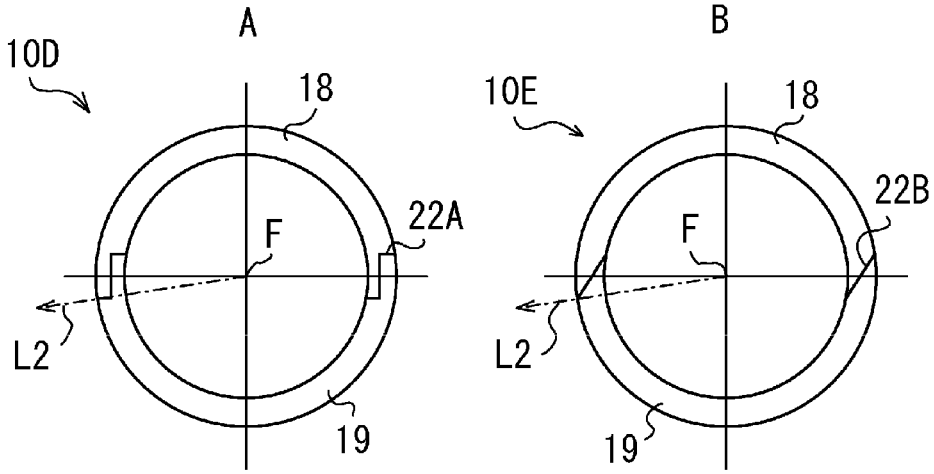
FIG. 8 is a set of views showing end faces of X-ray tube holders of the X-ray generation device in the embodiment according to the present invention.
Figure 9:
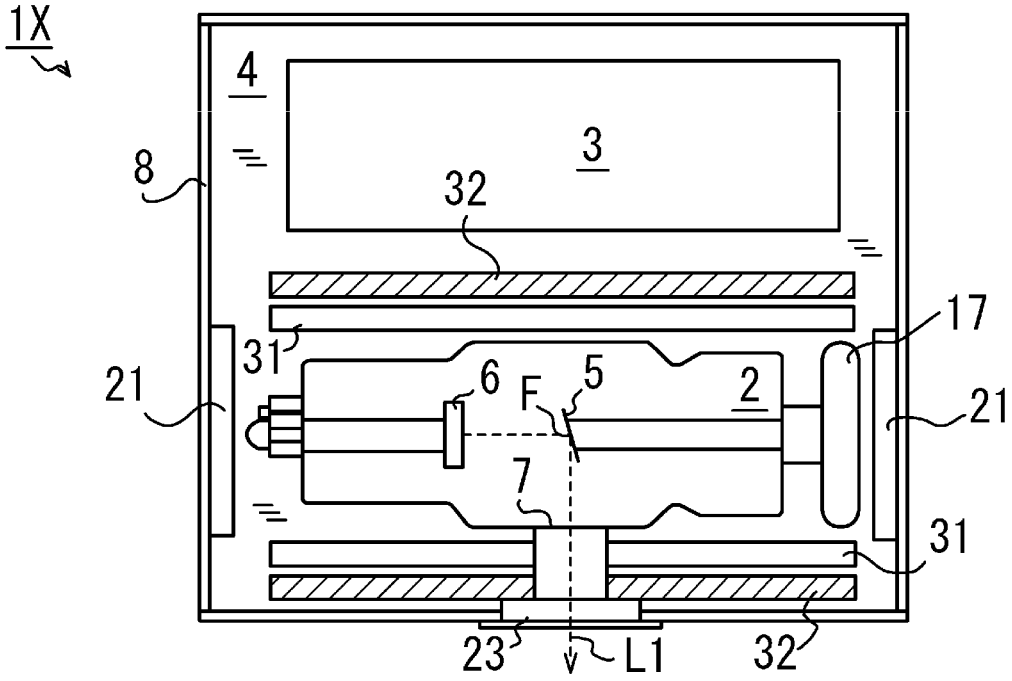
FIG. 9 is a view showing a conventional X-ray generation device.

Part A of FIG. 8 shows a view of an end face of an X-ray tube holder 10D. The interfaces of the upper holder 18 and the lower holder 19 (see FIG. 2) of the X-ray tube holder 10D are formed as joining surfaces 22A obtained by partly cutting away the interfaces. This X-ray tube holder 10D is formed by arranging the X-ray tube 2 thereinto and then adhering the joining surfaces 22A to each other with adhesive or the like. By this configuration, it is possible to prevent the possibility that the scattering X rays L2 emitted from the focal spot F pass through the joining surfaces 22A and leak to the outside.

Part B of FIG. 8 shows an end face of an X-ray tube holder 10E. The interfaces of the upper holder 18 and the lower holder 19 of this X-ray tube holder 10E are formed as slanted joining surfaces 22B. By this configuration, it is possible to more securely prevent the possibility that the scattering X rays L2 emitted from the focal spot F pass through the joining surfaces 22A and leak to the outside.

EXPLANATION OF REFERENCE NUMERALS

| | |
|---|---|
| 1 | X-ray generation device |
| 2 | X-ray tube |
| 3 | high-voltage generation unit |
| 4 | insulating oil |
| 5 | anode |
| 6 | cathode |
| 7 | X-ray irradiation window |
| 8 | housing |
| 10, 10A, 10B, 10C, 10D, 10E | X-ray tube holder |
| 11 | slit |
| 12 | slanted slit |
| 14 | oil circulation passage |
| 16 | heat radiation unit |

The invention claimed is:

1. An X-ray generation device including an X-ray tube and a high-voltage generation unit inside a housing and also having insulating oil filled in the housing, the X-ray tube being configured to generate an X ray, the X-ray generation device characterized in that the X-ray tube is arranged inside an X-ray tube holder covering the X-ray tube entirely in a circumferential direction thereof, a material of the X-ray tube holder contains at least bismuth oxide and a resin, the X-ray tube holder includes an opening and a plurality of slits, the opening being provided in a portion corresponding to an X-ray irradiation window through which the X-ray tube applies the X ray, the slits allowing the insulating oil to circulate between an inside and an outside of the X-ray tube holder, and each of the slits of the X-ray tube holder is formed in such a way as to maintain an X-ray shielding distance with which X rays scattering radially from the X-ray tube are shielded, and to be slanted from the outside to the inside of the X-ray tube holder in such a direction that an inner opening of the slit is further away from a focal spot of the X-ray tube than is an outer opening of the slit.

2. The X-ray generation device according to claim 1, characterized in that the X-ray tube holder includes an upper holder and a lower holder divided from each other at a plane parallel to a central axis of the X-ray tube holder which is in a cylindrical shape, and in a cross section perpendicular to a central axis of the X-ray tube, joining surfaces of the upper holder and the lower holder are surfaces slanted in a direction crossing advancing directions of the X rays scattering radially from the X-ray tube.

3. The X-ray generation device according to claim 1, characterized in that the X-ray tube holder includes an oil circulation passage connected to the slits, and a heat radiation unit connected to the oil circulation passage, and the X-ray tube holder has a configuration in which the insulating oil is sent to the heat radiation unit through the oil circulation passage, cooled down by the heat radiation unit, and returned into the X-ray tube holder.

4. The X-ray generation device according to claim 2, characterized in that the X-ray tube holder includes an oil circulation passage connected to the slits, and a heat radiation unit connected to the oil circulation passage, and the X-ray tube holder has a configuration in which the insulating oil is sent to the heat radiation unit through the oil circulation passage, cooled down by the heat radiation unit, and returned into the X-ray tube holder.

5. An X-ray generation device including an X-ray tube and a high-voltage generation unit inside a housing and also having insulating oil filled in the housing, the X-ray tube being configured to generate an X ray, the X-ray generation device characterized in that the X-ray tube is arranged inside an X-ray tube holder covering the X-ray tube entirely in a circumferential direction thereof, a material of the X-ray tube holder contains at least bismuth oxide and a resin, the X-ray tube holder includes an opening and a plurality of slits, the opening being provided in a portion corresponding to an X-ray irradiation window through which the X-ray tube applies the X ray, the slits allowing the insulating oil to circulate between an inside and an outside of the X-ray tube holder, the slits of the X-ray tube holder are formed along directions crossing advancing directions of X rays scattering radially from the X-ray tube, and widths of openings of the slits formed at positions further from a focal spot of the X-ray tube are set greater than widths of openings of the slits formed at positions closer to the focal spot.

6. The X-ray generation device according to claim 5, characterized in that the X-ray tube holder includes an upper holder and a lower holder divided from each other at a plane parallel to a central axis of the X-ray tube holder which is in a cylindrical shape, and in a cross section perpendicular to a central axis of the X-ray tube, joining surfaces of the upper holder and the lower holder are surfaces slanted in a direction crossing advancing directions of the X rays scattering radially from the X-ray tube.

7. The X-ray generation device according to claim 5, characterized in that the X-ray tube holder includes an oil circulation passage connected to the slits, and a heat radiation unit connected to the oil circulation passage, and the X-ray tube holder has a configuration in which the insulating oil is sent to the heat radiation unit through the oil circulation passage, cooled down by the heat radiation unit, and returned into the X-ray tube holder.

8. An X-ray generation device including an X-ray tube and a high-voltage generation unit inside a housing and also including insulating oil filled in the housing, the X-ray tube being configured to generate an X ray, the X-ray generation device characterized in that the X-ray tube is arranged inside an X-ray tube holder covering the X-ray tube entirely in a circumferential direction thereof, a material of the X-ray tube holder contains at least bismuth oxide and a resin, the X-ray tube holder includes an opening and a plurality of slits, the opening being provided in a portion corresponding to an X-ray irradiation window through which the X-ray tube applies the X ray, the slits allowing the insulating oil to circulate between an inside and an outside of the X-ray tube holder, the slits of the X-ray tube holder are formed in such a way as to maintain an X-ray shielding distance with which X rays scattering radially from the X-ray tube are shielded, and to extend from the outside to the inside of the X-ray tube holder in directions perpendicular to a central axis of the X-ray tube, the X-ray tube holder includes an upper holder and a lower holder divided from each other at a plane parallel to a central axis of the X-ray tube holder which is in a cylindrical shape, and in a cross section perpendicular to the central axis of the X-ray tube, joining surfaces of the upper holder and the lower holder are surfaces slanted in a direction crossing advancing directions of the X rays scattering radially from the X-ray tube.

9. The X-ray generation device according to claim 8, characterized in that the X-ray tube holder includes an oil circulation passage connected to the slits, and a heat radiation unit connected to the oil circulation passage, and the X-ray tube holder has a configuration in which the insulating oil is sent to the heat radiation unit through the oil circulation passage, cooled down by the heat radiation unit, and returned into the X-ray tube holder.

* * * * *